US005473785A

United States Patent [19]

Lager et al.

[11] Patent Number: 5,473,785

[45] Date of Patent: Dec. 12, 1995

[54] TRAVELING COLLAPSIBLE TODDLER BED

[76] Inventors: Bengt G. Lager; Luanne Whiting-Lager, both of 1506 Waynesborough Ct., Marietta, Ga. 30062

[21] Appl. No.: 145,779

[22] Filed: Oct. 29, 1993

[51] Int. Cl.[6] ..... B68G 5/00

[52] U.S. Cl. ..... 5/655; 5/420; 5/427

[58] Field of Search ..... 5/420, 427, 98.1, 5/99.1, 425, 655

[56] References Cited

U.S. PATENT DOCUMENTS

| | | | |
|---|---|---|---|
| 2,626,407 | 1/1953 | Kurry | 5/99 |
| 3,336,608 | 8/1967 | Lerner | 5/98.1 |
| 3,513,489 | 5/1970 | Miller et al. | 5/98.1 |
| 4,197,601 | 4/1980 | Maquire | 5/416 |
| 4,698,862 | 10/1987 | Mairs | 5/98.1 |
| 4,754,509 | 7/1988 | Pollard | 5/425 |
| 4,819,284 | 4/1989 | Brown | 5/98 |
| 4,890,346 | 1/1990 | Rist | 5/427 |
| 4,991,245 | 2/1991 | Franco | 5/419 |
| 4,999,863 | 3/1991 | Kane | 5/98.1 |
| 5,085,212 | 2/1992 | DeCosta | 5/420 |
| 5,103,514 | 4/1992 | Leach | 5/417 |
| 5,165,130 | 11/1992 | Wendling | 5/655 |

OTHER PUBLICATIONS

Playmat/Play–Yard product brochure, Apr. 1987.

*Primary Examiner*—Michael J. Milano
*Attorney, Agent, or Firm*—Hopkins & Thomas

[57] ABSTRACT

A traveling bed arrangement for infants and small children has a rectangular sheet member to which are affixed, along the edges thereof, a plurality of pockets. Plastic foam boards are insertable in the pockets which are folded up and fastened to form a walled bed or play area. The boards are all substantially identical to each other and are sufficiently rigid to protect the child, but sufficiently resilient to yield if a child falls against them. The bed is readily disassembled and the components thereof rolled up and inserted in a lightweight bag for transport.

6 Claims, 3 Drawing Sheets

TRAVELING COLLAPSIBLE TODDLER BED

FIELD OF INVENTION

This invention relates to a travel bed and utility pad for small children and, more particularly, to a light weight portable pad arrangement having side and end restraints.

BACKGROUND OF THE INVENTION

Infants and small children generally require a large measure of protection when playing or sleeping, especially when left alone. The dangers to such small children are numerous, such as falls, bruises, unsanitary areas, such as rugs or floors, onto which the child might stray, or, where a restraint means is used, being caught or tangled in the restraint means.

Most commonly, such small children are placed in cribs or play pens which are relatively fixed as to location, and which are often padded to protect the child and afford it a measure of comfort. Thus, the slats of the crib are often draped with pads to prevent the child from being caught between slats, and to cushion the child if it should fall against the sides of the crib. From a safety and child security standpoint, a crib or playpen thus padded is excellent, however, it is not conveniently portable and thus is quite difficult to carry on trips. Thus, when the parent and child are staying in a hotel room, for example, unless the hotel has cribs or playpens available, there is no ready means for protecting the child while it plays or sleeps.

By the time that a child has outgrown a travel crib, at about two years of age, he or she tends to feel too confined by a crib and starts to try to climb out. This can be extremely dangerous inasmuch as the child can fall or become tangled in the crib while trying to get out. As a consequence, the alternatives to a crib, such as an adult bed or a sleeping bag, are often used. However, children usually roll frequently while sleeping, and can roll off the bed. A sleeping bag has its own drawbacks, such as the possibility of the child ending up totally inside of the bag, with a danger of suffocation, or rolling out of the bag onto the unsanitary floor or rug.

When a child is ill, or subject to bad dreams or the like, the parents want the child to sleep near them, but not in bed with them. Thus, a trundle bed arrangement, where the bed can be stored under the parents' bed and pulled out when needed, is desirable.

As a consequence, there has been a great deal of emphasis placed on designing portable arrangements for children that can be easily transported and, where necessary, quickly assembled, and which afford the child a reasonable measure of protection. The prior art is replete with such devices, an example of which is shown in U.S. Pat. No. 2,626,407 of Kurry. The device of that patent is a folding crib which can be carried in a case and unfolded for use. The crib comprises a pair of bottom portions of cardboard or the like which can be folded together and unfolded to form the floor of the crib. A hollow U-shaped rim extends along the periphery of each of the bottom portions and is filled with a soft filler material. The rim portions are attached to the bottom portions so that when the bottom portions are folded, the butting ends of the U-shaped rims separate. The crib is designed to be placed upon a bed or sofa and the mattress or cushions thereof constitute the cushioning means for the crib. The rim members protect the child so that it cannot roll off the bed.

In U.S. Pat. No. 5,103,514 of Leach there is shown a portable utility pad which comprises a rectangular fabric tube filled with cushioning material having a sheet of fabric attached thereto to form a floor for the pad. The entire assembly may be folded into a compact triangular configuration and held there by fasteners. A pair of Velcro® straps form a handle for carrying the triangular bundle.

U.S. Pat. No. 5,088,139 of Bloom discloses a play mat having a cushioned base portion and a cushioned circular wall portion, secured to each other by suitable means, such as a zipper. The mat can be folded up for transport and stored in a carrying case that is integral therewith.

The arrangements of prior art thus far discussed all have cushioned wall portions wherein the cushioning material is integral with or incorporated into the wall structure, which materially adds to the bulk of the folded member, as well as necessitating, at least in some cases, a unique or special way of folding the member for transport. In U.S. Pat. No. 4,754,509 of Pollard, there is shown a sleeping pad for infants or patients which comprises a retainer sheet upon which are attached and arrayed in a rectangular configuration a plurality of pockets. Cylindrically shaped foam members are insertable into the pockets to form a walled rectangular enclosure in which the child or patient can be placed. The sheet itself is designed to be fitted to the mattress of a bed so that it does not shift or slide, thus affording a stable, fixed enclosure. U.S. Pat. No. 5,165,130 of Neudling likewise discloses walls formed by cushions insertable into pockets formed on a flexible panel.

None of the foregoing patents discloses an infant bed or playpen that can be broken down into its component parts for easy transportability. In most cases, as with the Kurry, Leach, and Bloom arrangements, the bed or pad is rolled up, usually in a complicated manner, to form a somewhat bulky package. While the Pollard arrangement can be broken down into components, the components themselves are bulky, and there is no suggestion as to how the disassembled bed is to be folded and transported.

The prior art arrangements fail to show, in one or more particulars, a utility pad arrangement for infants, e.g., children below the age of two years, which is also a trundle bed arrangement for small children, e.g., children from two to six years old. Such an arrangement would be highly desirable and useful.

SUMMARY OF THE INVENTION

The present invention, in a preferred embodiment thereof, is a trundle bed or utility pad which comprises a sheet of relatively soft, flexible material such as, for example, nylon which may be coated with a thin film of polyurethane, for example, to render it waterproof and easily cleanable. The sheet, which is preferably, although not necessarily, rectangular in shape has attached along each edge a pocket member which comprises two layers of the sheet material and extends along the length of the side to which it is attached. Thus, the sheet has attached thereto two open ended end pockets, one at each end, and two open ended side pockets, one extending along each side, with the length of each side pocket being an integral multiple, preferably two, of the length of each end pocket.

A plastic foam, preferably rectangularly shaped, board is insertable into each of the end pockets, the two boards being substantially identical in dimensions and formed by polypropylene foam, for example. First and second substantially identical polyethylene boards are inserted into each of the side pockets into butting relationship with each other so that each side pocket is substantially filled with the boards.

Preferably, each of the first and second boards is identical to the boards in the end pockets so that all six boards are interchangeable.

Each of the side pockets has, at each end, a tab or extension member to which is affixed a Velcro® or other type hook and loop fastening member, and each of the end pockets has, at each end on the under side thereof, a matching Velcro® or other type hook and loop member. When the boards are in place in their pockets, the side and end pockets are folded up to form walls, and are fastened together by means of the Velcro® fasteners to hold them firmly in place. A mattress member comprising a flexible sheet of polyethylene or polyurethane, which may be enclosed in a vinyl case, and having approximately the same width and length as the sheet surface within the walls, is placed upon the sheet within the confines of the walls for the child's comfort. If desired, the mattress may have Velcro® fasteners on the under side thereof which mate with Velcro® fasteners affixed to the top surface of the sheet to hold the mattress in place and prevent it from bunching up or sliding.

The assembled bed may quickly be broken down for transport by the user's removing the mattress, unfastening the ends of the pockets, and removing the side and end boards. For transporting, the side and end pockets are folded inward, the mattress laid on top, the boards stacked and laid on the mattress at on end, and the entire assemblage simply rolled up. The invention includes a simple duffel bag of nylon or the like into which the roll is stuffed. The open end of the bag is provided with a drawstring for closing the duffel, and a suitable handle and/or shoulder strap is affixed to the exterior of the bag for easy portability.

The bed of the invention is extremely light in weight and yet it is formed in such a manner as to provide both stability and safety so that it may be used on top of a bed, under or beside a bed, on the floor or a rug, on an irregular surface such as beach sand, or simply out of doors on the lawn or the like. It can quickly be broken down and stored in its bag without the necessity of any complicated folding arrangement, and hand carried, or included with other luggage. Because the stiffening boards are all substantially identical, there is no confusion during assembly, as to which part goes where.

The various features and advantages of the present invention will be more readily apparent from the following detailed description, read in conjunction with the accompanying drawings.

DETAILED DESCRIPTION OF THE DRAWINGS

Figure 1:
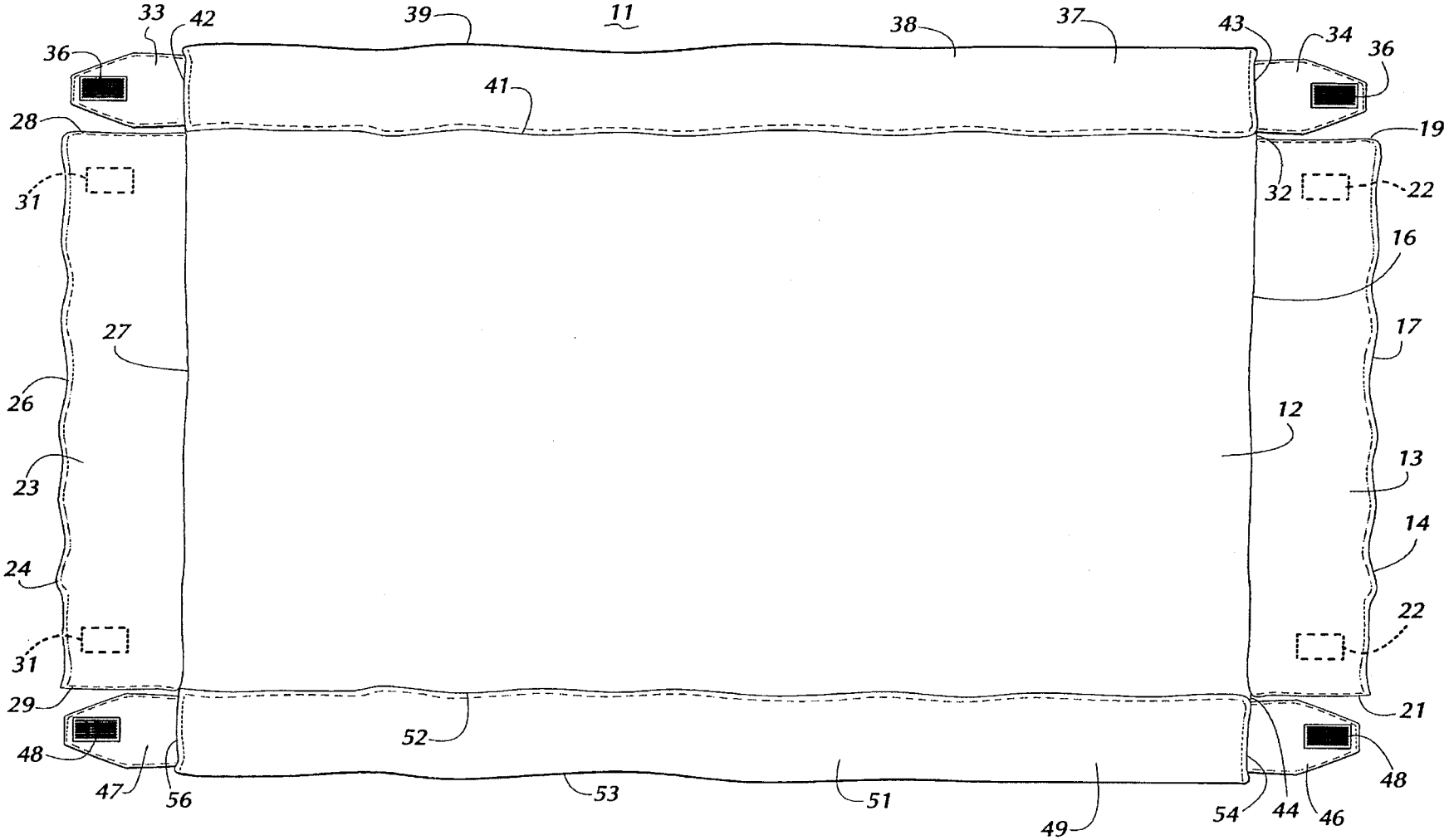
FIG. 1 is a plan view of the sheet member from which the bed of the invention is formed.

The sheet 11 of the invention, as shown in FIG. 1, is preferably made of a soft material such as nylon treated with a thin film of polyurethane to waterproof it. The polyurethane film also serves to make the sheet easily washable. Other materials besides nylon might also be used, such as cotton or a cotton blend, or vinyl, but nylon is preferred. Sheet 11 comprises a main support surface 12 which forms the bottom surface of the bed, and which, in the preferred embodiment, is rectangular in shape. For reasons which will be apparent hereinafter, the length of the surface 12 is preferably approximately twice the width. At one end of portion 12 and extending across the width thereof is a pocket member 13 which is formed by a strip of material 14 placed over an extension of sheet 12, with the long edges 16 and 17 affixed thereto as by stitching or other suitable means. The short edges 19 and 21 of strip 14 are not affixed to the extension of sheet portion 12, thereby forming pocket member 13 which is open at both ends. On the under side of pocket 13, i.e., the underside of the extension of sheet 12, are a pair of Velcro® strips 22,22, shown in dashed outline. On the other end of sheet 12, a second pocket 23 comprising a strip 24 having longitudinal edges 26 and 27 and side edges 28 and 29, is formed in the same manner as pocket 13 on an extension of sheet 12. The under side of the extension, and hence, the pocket, has Velcro® strips or patches 31, shown in dashed outline.

Sheet 12 has another extension 32 extending along a first longitudinal side thereof, and terminated at each end by tab members 33 and 34. Each tab member has a patch or strip 36 of Velcro® on the top surface thereof for mating with the Velcro® patches 22 and 31. A longitudinally extending pocket 37 is formed by overlaying extension 32 with a strip 38 of material and affixing the longitudinal edges 39 and 41 thereof to the edges of extension 32, with the ends 42 and 43 left open. On the other side of sheet 12 is another longitudinal extension 44 having tabs 46 and 47 and Velcro® strips 48,48 for mating with strips or patches 22 and 31. A longitudinally extending pocket 49 is formed between extension 44 and a strip 51 of material overlaying extension 44 and affixed thereto along its longitudinal edges 52 and 53. The ends 54 and 56 of the pocket 49 are left open. Thus, as shown in FIG. 1, the basic element of the bed of the invention comprises a rectangular sheet 11 having four open ended pockets 13, 23, 37 and 49 along the edges thereof.

Figure 2:
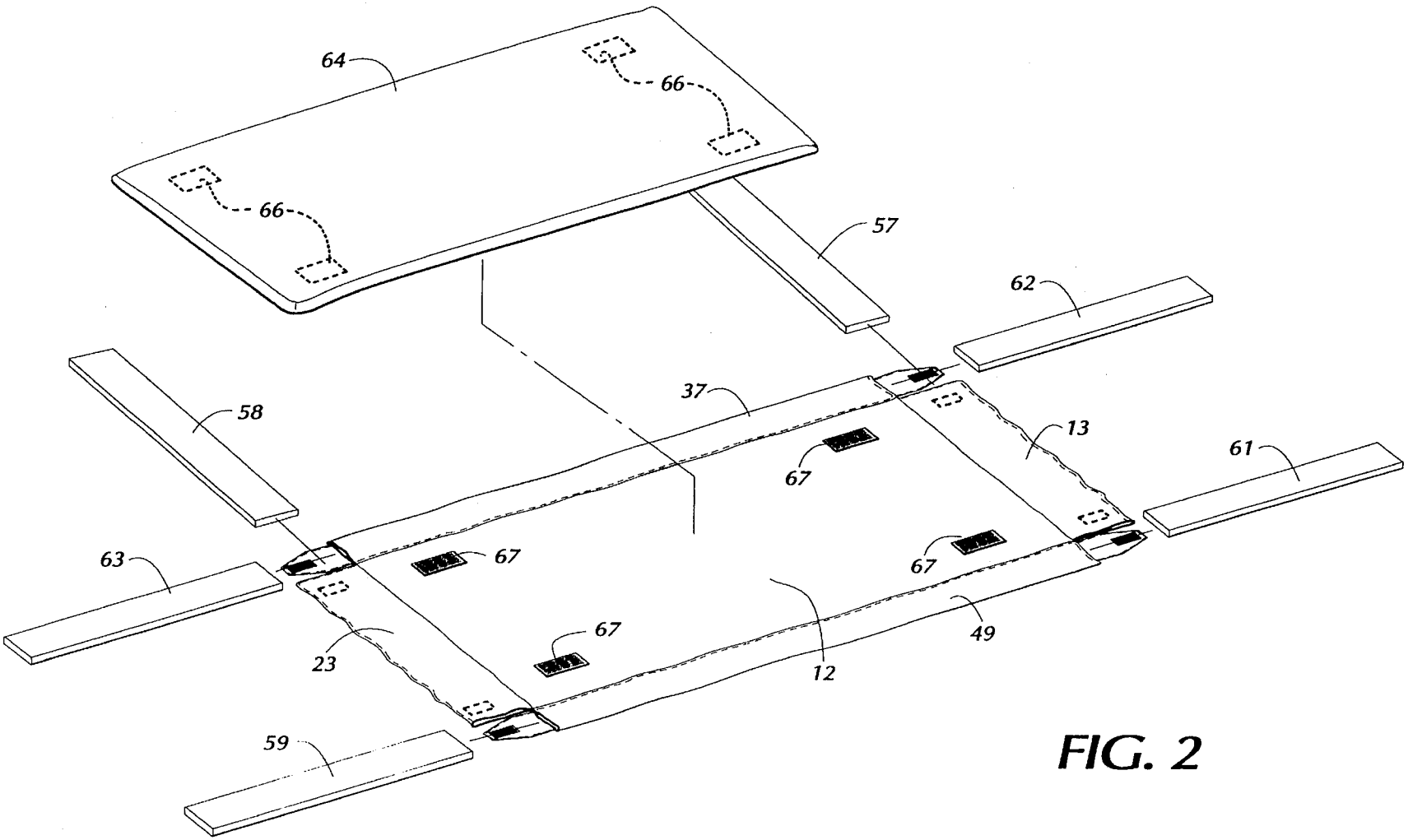
FIG. 2 is an exploded perspective view of the components of the bed of the invention showing their relationship to each other.

In FIG. 2 there is shown the various parts of the bed of the invention and their relationship and orientation relative to each other. In assembling the bed, the assembler slides first and second rectangular boards 57 and 58 into end pockets 13 and 23. Boards 57 and 58 are preferably made of semi-rigid polyethylene foam material which is extremely light in weight, but strong enough to withstand any shocks likely to be encountered. On the other hand, they are sufficiently soft and flexible enough to yield to impact of a child falling against them, for example. While polyethylene foam is a preferred material for boards 57 and 58, other foam materials made of, for example, polyurethane, polypropylene, or polystyrene might readily be used, provided the material is soft and flexible enough that the child, falling against it, will not be injured, yet rigid enough to hold its shape. Each of the boards 57 and 58 which are substantially identical are approximately three-quarters of an inch (¾") thick, and of approximately the same length and width as their respective pockets 13 and 23, but easily slidable into and out of the pockets.

A pair of boards 59 and 61, substantially identical to boards 57 and 58 are slidable into pocket 49, from either end, as shown, or from one end. As pointed out hereinbefore, the long dimension of sheet 11 is preferably twice the width. Hence, when boards 59 and 61, which are the same length as boards 57 and 58, are inserted into the pocket 49, they completely fill the pocket from end to end, and butt against each other at the midpoint of the pocket. In like manner, two boards 62 and 63 are insertable into pocket 37.

A mattress pad 64 having substantially the same dimensions as sheet 12 is adapted to be laid onto sheet 12. Pad 64, which may be made of polyurethane foam and which may have, as part of a mattress assembly, a vinyl or nylon cover, is approximately three-quarters of an inch (¾") thick, and provides a resilient and comfortable support for a child. Other foam materials might also be used for mattress 64, such as polyethylene, or, alternatively, mattress 64 might be an inflatable vinyl member. If desired, mattress 64 may have, on the underside thereof, strategically located patches 66,66, of Velcro®, as shown in dashed outline, which mate with similarly located Velcro® patches 67,67 on sheet 12. Such an arrangement insures that the mattress member or assembly 64 remains fixed in place and is prevented from sliding and bunching up.

Figure 3:
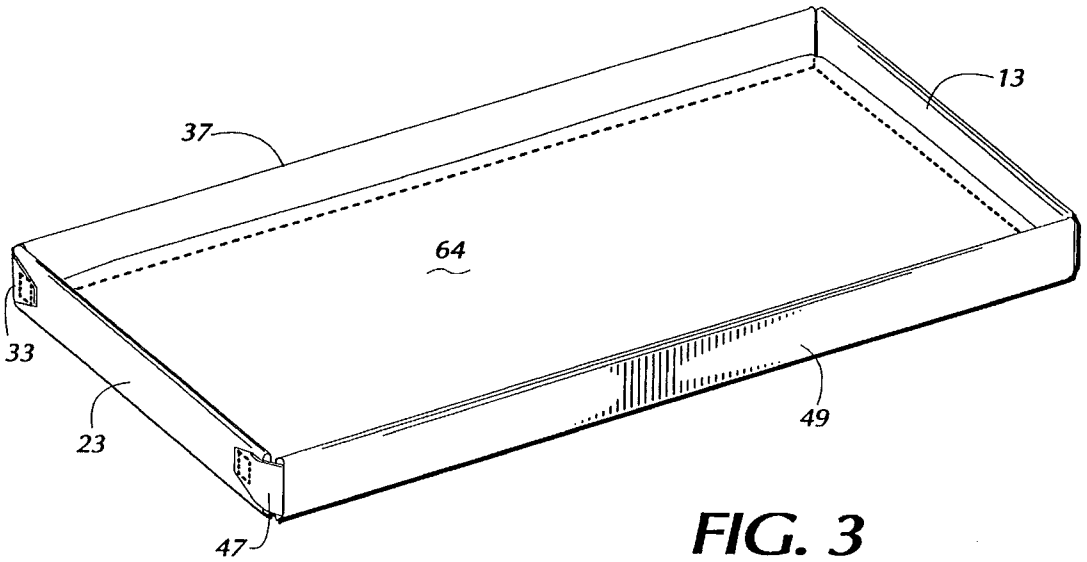
FIG. 3 is a perspective view of the bed of the invention as assembled and ready for use.

In FIG. 3, there is shown the completely assembled bed, ready for use. After the boards 57, 58, 59, 61, 62 and 63 are inserted into the pockets, as discussed hereinbefore, the pockets are folded up, as shown, and the tabs 33, 34, 46 and 47 are wrapped around the corners thus formed to where the Velcro® patches thereon mate with the corresponding patches on the undersides of the lateral pockets, thereby forming the walled bed as shown in FIG. 3. Mattress pad 64 fits within the walled enclosure and is held in place thereby, hence, the use of patches 66,66 and 67,67 is not strictly necessary, although such patches do insure against mattress 64 bunching up.

Figure 4:
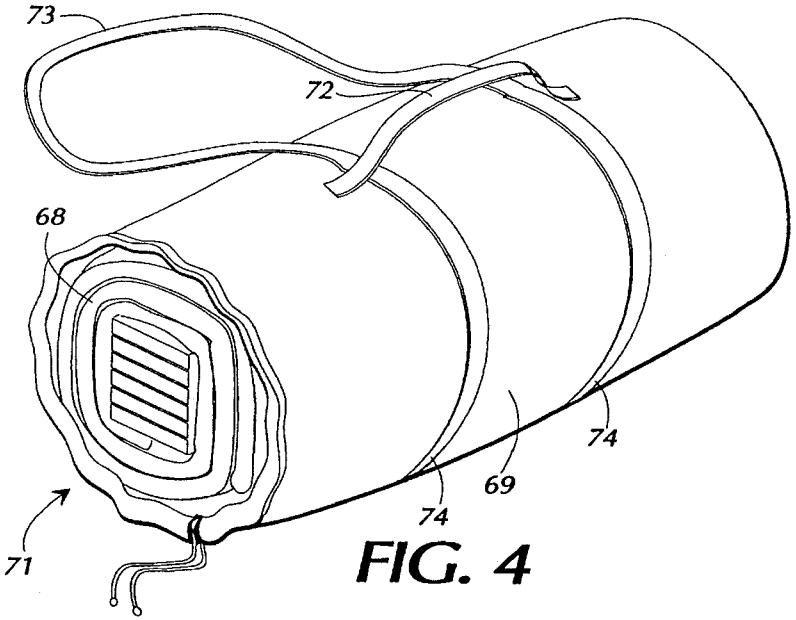
FIG. 4 is a perspective view of the disassembled elements of the bed of the invention stowed in the duffel bag.

In FIG. 4 the component parts of the disassembled bed are shown in the traveling configuration. As can be seen, the six boards 57, 58, 59, 61, 62 and 63 are stacked and the sheet 11 and mattress 64 are rolled up around them to form a roll 68 which can be inserted and carried in a bag 69. Bag 69 is closed at one end and has a draw string closure arrangement 71 at the other end to close the bag after insertion of the roll 68. Bag 69 is preferably made of the same material as the sheet 11, although this is not necessary. It is provided with a fabric carrying handle 72 and/or a shoulder strap 73. Reinforcing fabric bands 74,74 may also be provided. The entire assembly shown in FIG. 4 is so light that it can easily be carried by a child, all but perhaps the one for whom the bed is intended.

The foregoing embodiment of the invention, as shown in the drawings and described hereinbefore, is illustrative of the features and advantages thereof. It is clear that variations in the types of material, such as the Velcro® fasteners, which might be replaced by other suitable fastening means, are possible. One possible change could be enclosing the pockets and making them inflatable by means of suitable valve members. Numerous other changes or variations, such as the shape of the bed, might occur to workers in the art without departure from the spirit and scope of the invention.

We claim:

1. A method of disassembling a utility bed and pad wherein the bed comprises a flexible sheet member having pocketed end and side walls with cushioning means in the pockets, the end and side walls being fastened together by tab members at their junctions forming a confined walled area, the method comprising:

unfastening the tab members;

laying the end and side walls flat;

stacking the cushioning means and placing the stack on the flexible sheet member;

rolling the flexible sheet member around the stack to form a compact roll; and inserting the compact roll thus formed into a carrying member shaped to contain the roll.

2. A method of assembling a utility bed and pad from a compact roll formed by rolling a flexible sheet member about a stack of cushioning members of equal length, comprising the steps of:

unrolling said compact roll by unwrapping said flexible sheet member from around said stack of cushioning members;

inserting one of said cushioning members into each end pocket of said flexible sheet;

inserting one of said cushioning members into each side pocket of said flexible sheet;

folding the end pockets up to form end walls;

folding the side pockets up to form side walls; and folding tab members located at each end of the side pockets around the juntions of the end walls and side walls and fastening said tab members to the end walls to define a walled confined area.

3. The method of claim 2, further comprising the step of removing said compact roll from a carrying member which is shaped to contain said compact roll.

4. The method of claim 2, further comprising the step of affixing a pad member on top of said flexible sheet member.

5. A utility bed, comprising:

a rectangular flexible sheet member having upper and lower surfaces and a length which is twice a width of said flexible sheet member;

a plurality of cushioning members each having a length approximately equal to said width of said flexible sheet member and having a rectangular cross-section;

a pair of end pockets attached at either end of said flexible sheet member along said width, each of said end pockets for receiving one of said cushioning members;

a pair of side pockets attached at either side of said flexible sheet member along said length, each of said side pockets for receiving two of said cushioning members; and foldable tabs attached to each end of the side pockets and having one of a hook fastener member or a loop fastener member, said foldable tabs for being folded over ends of said end pockets so that said one of said hook fastener member or said loop fastener member mates with the other of said hook fastener member or said loop fastener member, said other of said hook fastener member or said loop fastener member being attached to said ends of said end pockets;

wherein said end and side pockets are at an angle relative to said flexible sheet member to define a confined area when said hook and loop fastener members are mated with each other.

6. The utility bed as set forth in claim 5, further comprising a rectangular pad having a length and width equal to said length and width of said flexible sheet member, said pad for being placed on top of said flexible sheet member.

* * * * *